US009839806B2

(12) United States Patent
Slaughter

(10) Patent No.: US 9,839,806 B2
(45) Date of Patent: Dec. 12, 2017

(54) CAM AND WEDGE BARBELL CLIP

(71) Applicant: Christopher Slaughter, Littleton, CO (US)

(72) Inventor: Christopher Slaughter, Littleton, CO (US)

( * ) Notice: Subject to any disclaimer, the term of this patent is extended or adjusted under 35 U.S.C. 154(b) by 0 days.

(21) Appl. No.: 15/135,175

(22) Filed: Apr. 21, 2016

(65) Prior Publication Data

US 2016/0310782 A1 Oct. 27, 2016

Related U.S. Application Data

(60) Provisional application No. 62/151,896, filed on Apr. 23, 2015.

(51) Int. Cl.
*A63B 21/072* (2006.01)
*A63B 21/078* (2006.01)

(52) U.S. Cl.
CPC ..... *A63B 21/0728* (2013.01); *A63B 21/0783* (2015.10); *A63B 21/0724* (2013.01)

(58) Field of Classification Search
CPC ..... A63B 21/0728; F16B 2/14; F16B 2/18–2/185; Y10T 403/7062–403/7066; Y10T 24/1414; Y10T 24/1424; Y10T 24/44291–24/44316; Y10T 24/44333; Y10T 24/44368
See application file for complete search history.

(56) References Cited

U.S. PATENT DOCUMENTS

| | | | | |
|---|---|---|---|---|
| 4,264,048 | A | 4/1981 | Silbernagel | |
| 4,453,449 | A | 6/1984 | Hollmann | |
| 4,639,979 | A * | 2/1987 | Poison | A63B 21/0728 24/273 |
| 4,893,810 | A | 1/1990 | Lee | |
| 5,591,109 | A | 1/1997 | Strnad | |
| 6,158,729 | A | 12/2000 | Tsai | |
| 6,582,158 | B1 | 6/2003 | Van Stein | |
| 7,891,060 | B2 | 2/2011 | Ross et al. | |
| 8,425,157 | B1 | 4/2013 | Goranson | |
| 8,827,878 | B1 * | 9/2014 | Ciminski | A63B 21/0728 482/107 |
| 2006/0196737 | A1 | 9/2006 | Swoffer | |
| 2008/0287271 | A1 * | 11/2008 | Jones | A63B 21/0728 482/107 |
| 2011/0315829 | A1 * | 12/2011 | Darnell | H02G 3/0456 248/67.5 |
| 2015/0038302 | A1 * | 2/2015 | O'Brien | A63B 21/0724 482/107 |

FOREIGN PATENT DOCUMENTS

| | | | |
|---|---|---|---|
| EP | 0254233 | B1 | 1/1988 |

* cited by examiner

*Primary Examiner* — Loan H Thanh
*Assistant Examiner* — Jennifer M Deichl
(74) *Attorney, Agent, or Firm* — Braxton, Hilton & Perrone, PLLC

(57) ABSTRACT

A clip having a cam and upper and lower curved sections with each upper and lower curved section having corresponding inner and outer curved wedges, the inner and outer curved wedges slidably engaging with each other and tightening about a barbell to secure a weight plate on a barbell upon rotation of a cam lever to a closed position.

20 Claims, 7 Drawing Sheets

CAM AND WEDGE BARBELL CLIP

This Application claims priority to U.S. Provisional Patent Application No. 62/151,896 filed Apr. 23, 2015, which is incorporated in its entirety herein by reference.

TECHNICAL FIELD

This disclosure relates generally to a clip for securing weight plates used in competitive or recreational weightlifting to a barbell. The system and apparatus disclosed herein provides a more efficient and effective clip that enables quick installation and removal upon the addition or removal of weight plates to a barbell. The system and apparatus disclosed herein employs a single cam design in conjunction with wedge-shaped arched portions of a clip that contact a portion of the circumference of a cylindrical barbell sleeve.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings and photographs.

DETAILED DESCRIPTION OF THE EMBODIMENTS

Figure 1:
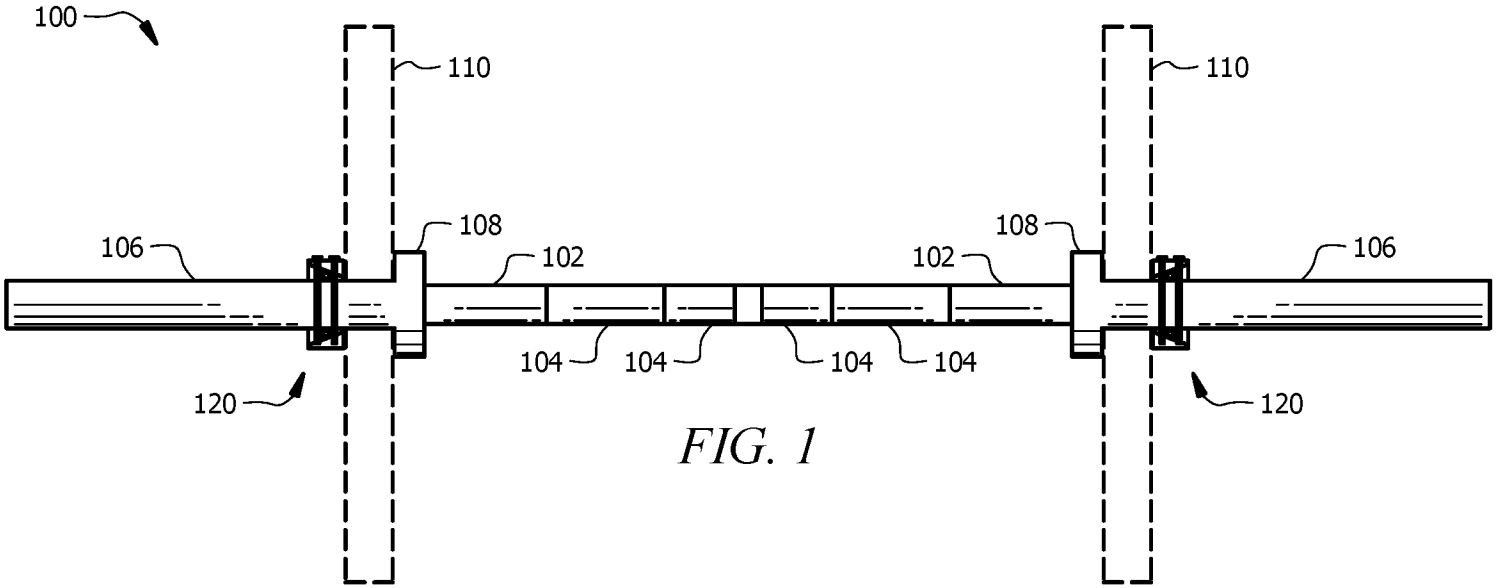
FIG. 1 depicts a barbell on which an embodiment of the presently disclosed barbell clip of is affixed.

In Olympic, competitive, or recreational weightlifting and weight training, barbells are used that include some basic components. Aside from the weights applied to the barbell, the barbell includes a steel bar, bearings and the sleeves. The sleeves include a collar. FIG. 1 depicts an example of a typical weight lifting bar. Barbell 100 includes a main bar 102, which is an elongated bar having a round cross section and a diameter sufficiently small allowing a user to easily grasp the bar for lifting. In one embodiment, hand placement sections 104 are marked on the main bar section 102. On each end of barbell 102 is a sleeve 106. Each sleeve 106 is an elongated member having a slightly larger diameter than bar 102. At an interior end of each sleeve 106 is collar 108. Sleeves 106 permit bar 102 to rotate within the sleeves that act as bearings and permit the lifter to keep his or her hands in contact with the bar 102 while executing a lift.

In operation, collar 108 and sleeve 106 operate as bearings to permit easy rotation of bar 102 relative to the weight plates. In dashed lines of FIG. 1, weight plates 110 that may be installed onto barbell 100 as shown. Weight plate 110 is typically a round or multi-sided plate of various weight made of steel, plastic, or the like. At the center of weight plate 110 is an opening through which sleeve 106 may be easily inserted. The opening of weight plate 110 is of sufficient diameter to allow insertion of sleeve 106 with relative ease.

Figure 2:
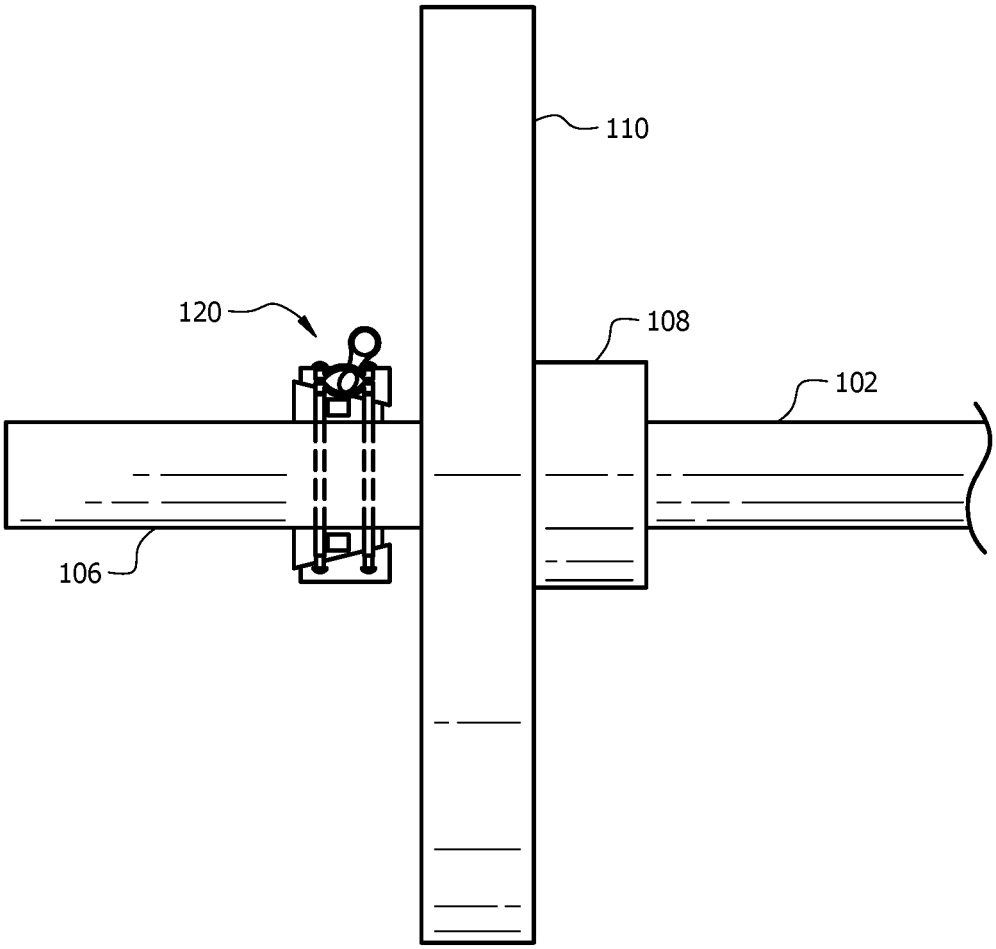
FIG. 2 depicts an alternative view of an embodiment of the presently disclosed barbell clip affixed to a barbell.

Once weight plates 110 are placed on barbell 100, the weight plates must be secured. Typically, weight plates 110 are secured on barbell 100 with a clip. In one embodiment of the presently described barbell clip, a clip 120 is situated on sleeve 106 of barbell 100 on the exterior side of weight plate 110 on opposite ends of barbell 100. As such, clip 120 secures weight plate 110 between collar 108 and clip 120 on sleeve 106, as shown in FIG. 2. In this manner, a weightlifter may execute various lifts with barbell 100 without concern that one or more of weight plates 110 will slide off of sleeve 106.

Figure 3:
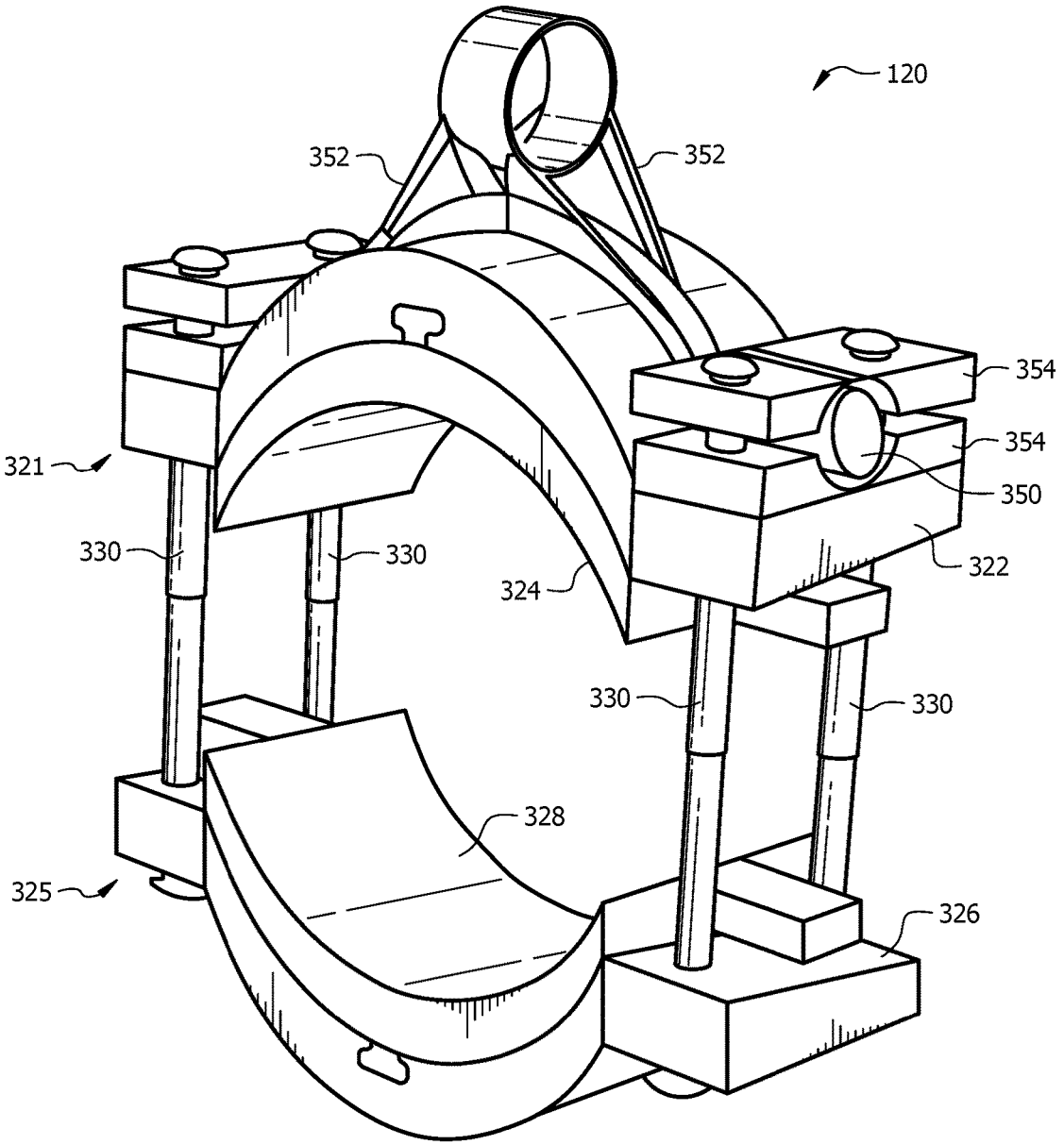
FIG. 3 depicts a perspective view of an embodiment of the presently disclosed barbell clip.
Figure 6A:
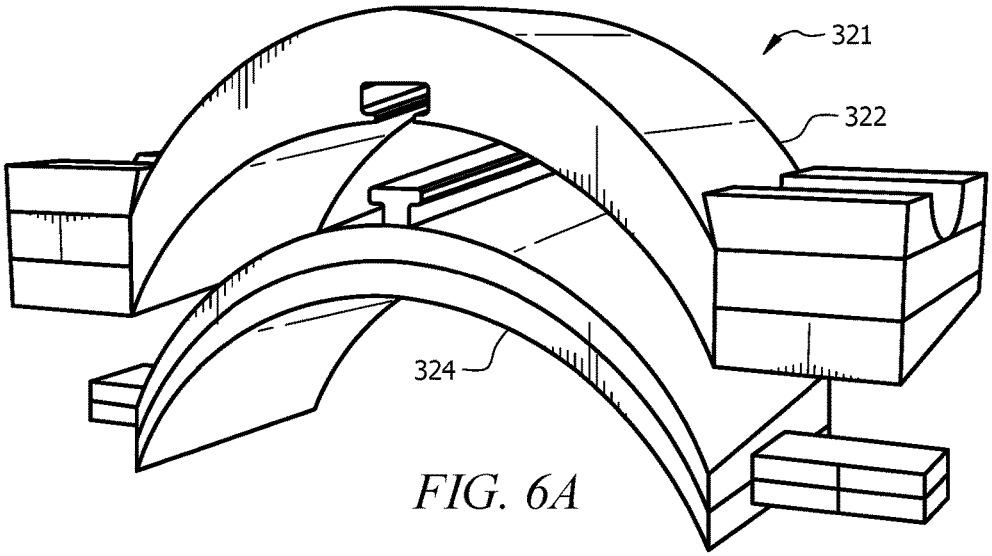
FIG. 6A is a view of an upper half of an embodiment of the presently disclosed barbell clip.
Figure 6B:
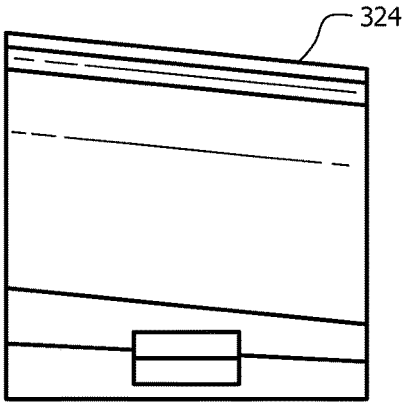
FIG. 6B is a side view of an embodiment of a wedge component of an embodiment the presently disclosed barbell clip.
Figure 6C:
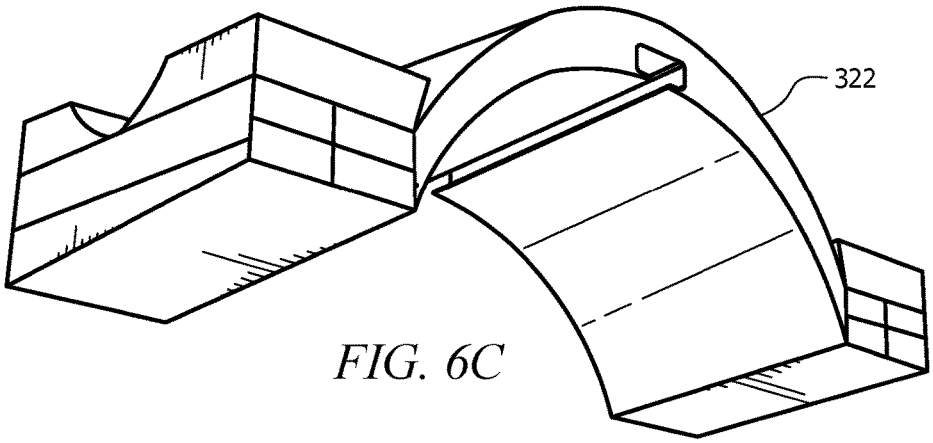
FIG. 6C is an isometric view of an embodiment of a wedge component of an embodiment the presently disclosed barbell clip.
Figure 6D:
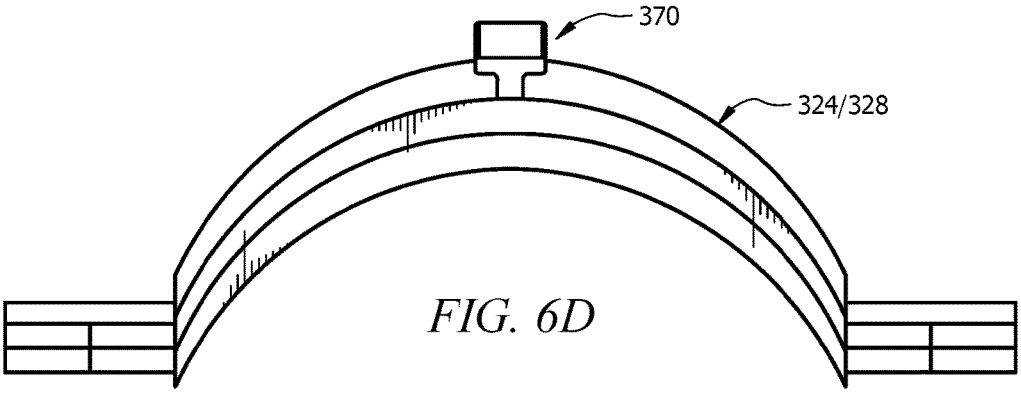
FIG. 6D is a front view of an embodiment of a wedge component of an embodiment the presently disclosed barbell clip.
Figure 6E:
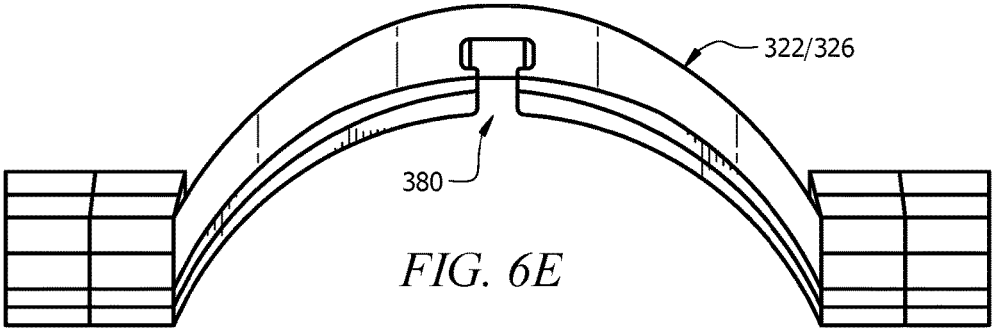
FIG. 6E is a front view of an embodiment of a wedge component of an embodiment the presently disclosed barbell clip.

One embodiment of the presently disclosed clip 120 is depicted in FIG. 3. Clip 120 is constructed of an upper clip half 321 and a lower clip half 325. Upper clip half 321 comprises an outer wedge 322 and an inner wedge 324. Similarly, lower clip half 325 comprises an outer wedge 326 and an inner wedge 328. Each of the outer and inner wedges of the clip halves include a slot and a fin to hold together each outer wedge and inner wedge and to keep each part aligned. As shown in FIGS. 6D and 6E, fin 370 associated with inner wedge 324 or 328 slides into slot 380 associated with upper wedge 322 or 326 to keep each wedge connected and aligned.

Continuing with FIG. 3, upper clip half 321 and lower clip half 325 are connected by four shafts 330. In one embodiment, each shaft 330 is cylindrical and connects upper clip half 321 with lower clip half 325 via a series of holes bored through each clip half. A cap is affixed to the end of each shaft to prevent the upper and lower clip from disconnecting and keep the upper clip half and lower clip in position. Upper clip half 321 also includes a single cam configuration. As shown, a cam 350 is associated with a first side of upper clip half 321 and a cam arm 352 is associated cam 350. On opposite ends of the upper clip half 321 is a set of holder plates 354. These holder plates encompass cam 350.

In operation, clip 120 is placed in position on barbell 100 by sliding clip 120 so as to secure weigh plate 110 against collar 108. While clip 120 is placed into position against weight plate 110, cam 350 is in an open position, meaning clip 120 may easily pass over sleeve 106 as it is placed in position against weight plate 110. During the installation of clip 120, the cam being in the open position causes holder plates 354 to be separated by a distance d. Once clip 120 is positioned in the desired location along sleeve 106 and against weight plate 110, clip 120 may then be tightened so as not to move from that location. This tightening is achieved by rotating each cam arm 352 so as to cause rotation of cam 350 to a vertical position as shown in FIG. 3. Upon cam 350 reaching the vertical or closed position, force is exerted on each of the holder plates along the vertical axis. In turn the distance between holder plates 354 increases to, for example, a distance 3*d*.

The increase of force along the vertical axis of holder plates 354 is significant. The presently disclosed clip offers the advantages of ease of installation and removal. Known barbell clips require significant force to tighten and loosen the clip at the start and completion of a barbell's use. Some clips spin around the associated sleeve, making application of the necessary force for tightening and loosening all the more difficult and possible causing injury to the user's hands. Known clips, however, must include closure mechanisms that create a very tight fit prior to any weightlifting operation. This is necessary because during execution of a lift, the weight plates situated on the barbell move laterally. As such, outward lateral force is repeatedly exerted onto each clip during execution of a lift. Unless the clip is extremely tight, this force will cause the clip to move outwardly away from the weigh plate and perhaps loosen and ultimately fall off of the sleeve. In addition, the repeated lateral force applied to the clip may compromise the clip and ultimately cause the clip to break and fail.

Figure 4:
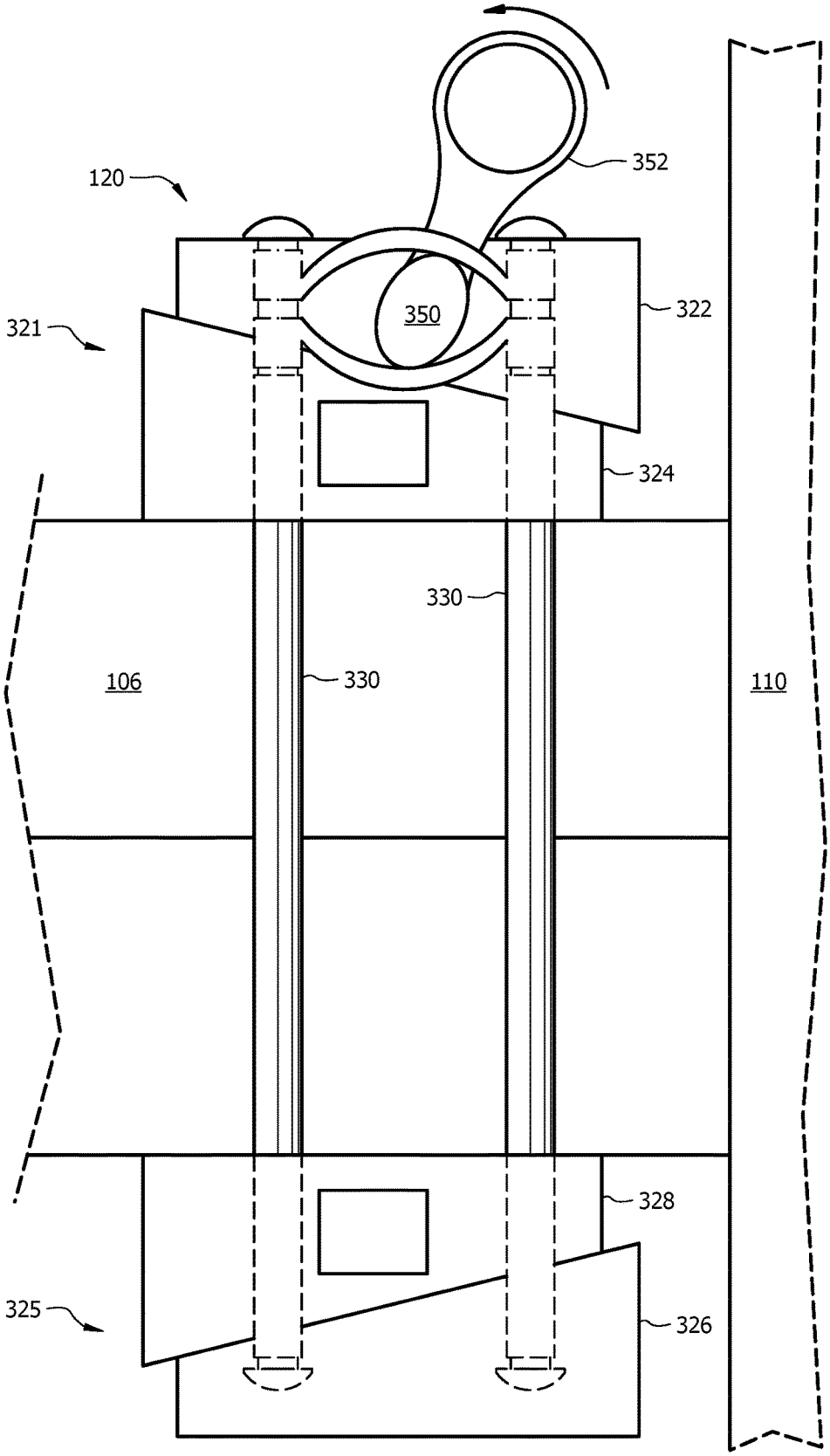
FIG. 4 is a side view of an embodiment of the presently disclosed barbell clip in an open position.

An embodiment of the presently disclosed clip 120 provides an easily installed and removed clip while accommodating and taking advantage of the lateral force exerted onto clip 120 during execution of a barbell exercise. Upper clip half 321 and lower clip half 325 are each advantageously configured as comprising an inner and outer wedge. As discussed, upper clip half 321 includes outer wedge 322 and inner wedge 324. Similarly lower clip half 325 includes outer wedge 326 and inner wedge 328. As discussed, as cam 350 is placed in the closed position by rotating cam arm 352, the gap between holder plates 354 increases. In turn, force along the vertical axis is exerted onto outer wedge 322 of upper clip half 321. At the same time, the tightening or closing of cam 350 causes outer wedge 326 of lower clip half 325 to be forced against inner wedge 328 of lower clip half 325. FIG. 4 depicts an embodiment of clip 120 in closed or locked position. This is evident from the displacement of outer wedge 322 in relation to inner wedge 324 of upper clip half 321 and similar displacement of outer wedge 326 in relation to inner wedge 328 of lower clip half 325. Note that in FIG. 4, the secured weight plate 110 is located to the right of clip 120.

Figure 5:
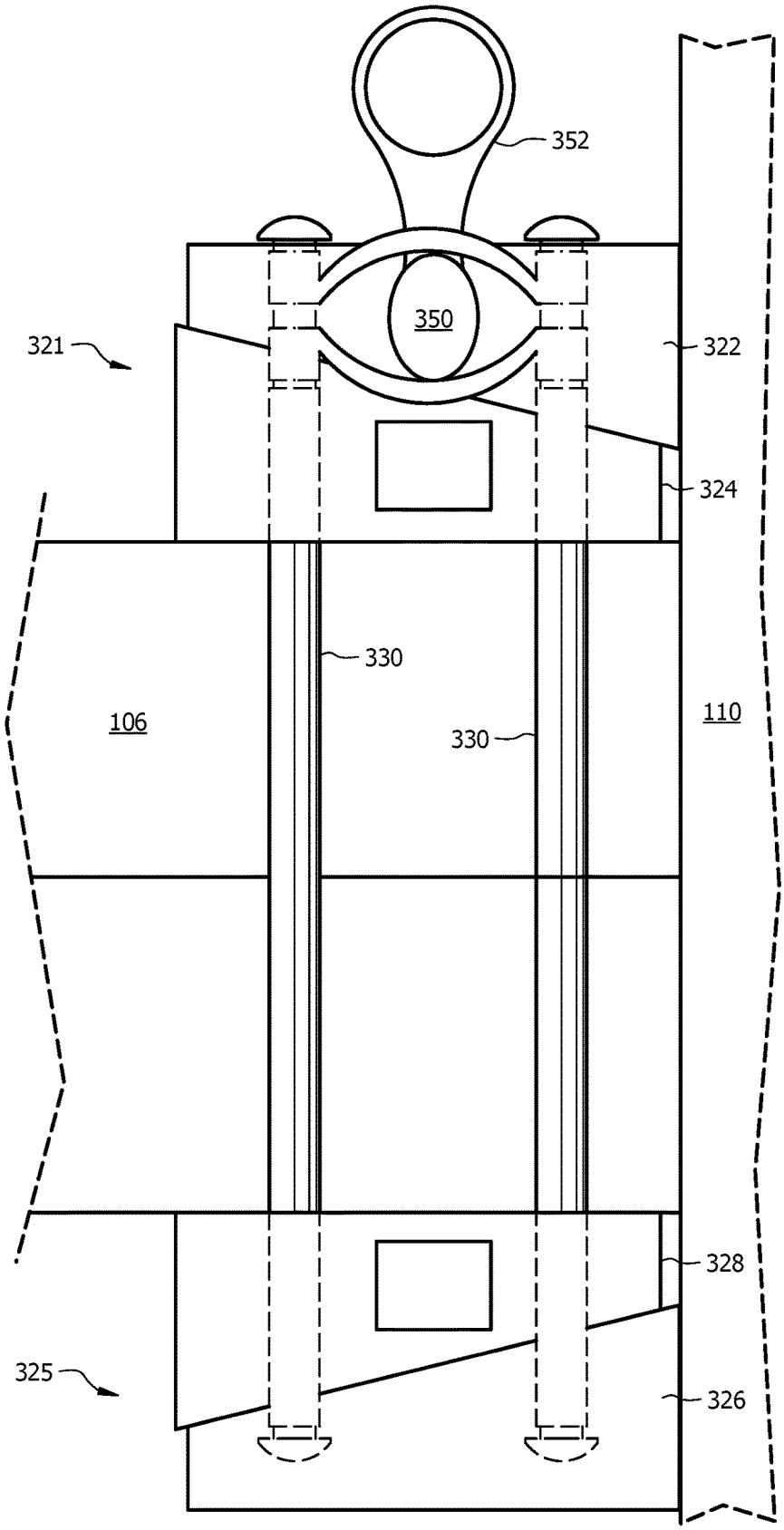
FIG. 5 provides a side view of an embodiment of the presently disclosed barbell clip in a closed position.

Referring back to FIG. 3, cam 350 is in the closed or tightened position, causing the increased gap between holder plates 354, and consequential additional force asserted along the vertical axis causing the tightening or further aligning of the inner and outer wedges of the upper and lower halves of clip 120. When this aligning occurs by increasing the gap between holder plates 354 it pushes the outer wedges inward, and reduces the diameter the outer wedges are able to maintain, which in turn causes them to slide downward in a direction as seen in FIG. 4, which would be closer to the weight plates. FIG. 5 provides another view of the positioning of the outer and inner wedges upon closure or tightening of cam 250 of clip 120. In FIG. 5, cam 350 is moved via rotation of cam arm 352 to the closed or tightened position. Note that cam arm 352 is in the vertical or "twelve o'clock" position in this embodiment, but other relationships between cam arm 352 and cam 350 to achieve the closed or locked position may be employed. In this closed position, the outer wedges (324/326), which are connected to the inner wedges (324/328), are forced together. When clip 120 is placed against weight plate 110, the rotation (closing) of cam arm 352 and corresponding rotation of cam 350 causes outer wedges 322 and 326 to be forced "downhill" against inner wedges 324 and 328, respectively. Inner curved wedges and outer curved wedges of clip 120 may be constructed of rubber, hard plastic or other materials with suitable gripping and expansion and contraction properties. Other portions of clip 120 such as the cam, cam lever and shafts may be constructed of metal, hard plastic or other material of suitable durability.

Note, however, in FIG. 5 although cam 350 is in the closed or tightened position, the entirety of the upper clip half 321 and lower clip half 325 are not flush against weight plate 110. Upon initial closure of clip 120 as shown via placing cam 350 in the closed position, each set of outer and inner wedges are not fully aligned. As shown, only the outer wedge 322 of upper clip half 321 and outer wedge 326 of lower clip half 325 come into contact with weight plate 110. This means that clip 120 may be tightened further. This further tightening is achieved through the lateral force that weight plate 110 exerts on clip 120 during execution of a barbell exercise. As discussed, each repetition of an exercise causes the weight plates 110 to shift laterally against clip 120. For example, if the user of barbell 100 is performing a familiar curl exercise to increase biceps strength, the motion of the barbell or the barbell being held not perfectly parallel may cause weight plates 110 to attempt to shift outward laterally away from the user's hands, which are placed on the main barbell section between weight plates 110. Another example is when a barbell with weights installed is dropped to the floor and the bouncing motion may cause lateral forces that make weights 110 want to shift laterally.

When the barbell is set to rest on a rack or the floor the lateral pressure from the weights 110 is released, thus reducing the lateral force applied to clip 120. With each barbell movement causing weight plate 110 to exert force on clip 120, outer wedge 322 of upper clip half 321 and outer wedge 326 of lower clip half 325 are forced uphill against corresponding inner wedges 324 and 328. This causes further tightening of the clip. In turn, less force is absorbed by cam 350 and cam arm 352 during barbell use, making the clip less susceptible to breakage due to repeated strain on the closing mechanism. Thus, while the upper and lower halves of clip 120 along with cam 350 and cam arm 352, in conjunction with shafts 330 provide sufficient resistance, tension and friction to ensure initial security of weight plates 110 on barbell sleeves 106, only enough tension and friction is created for initial locking of clip 120 onto sleeve 106. It is the additional lateral movement of weight plates 110 during normal weightlifting that creates additional lateral force onto clip 120 and specifically the outer and inner wedges (322/324 and 326/328) that maximize effective tightening of clip 120 around the sleeve. Accordingly, a clip with increased ease of installation and removal is achieved because only so much force as is necessary to initially tighten the clip and eventually remove the clip is required of the user. The upper and lower wedge configuration that receives the lateral force of the weight plates 110 created by movement of the barbell causes the additional tightening to maintain the position of the each clip 120 on each sleeve 106. Thus, the difficulty endured with affixing and removing barbell clips from a barbell is eliminated.

Other views of various components of an embodiment of clip 120 are also provided. In FIG. 6A, outer wedge 322 and inner wedge 324 of upper clip half 321 are shown in isolation. FIG. 6B depicts a side view of inner wedge 324 of upper clip half 321. FIG. 6C depicts another view of outer wedge 322 of the upper clip half 321. FIG. 6D depicts the inner wedge 324 or 328 of the upper clip half 321 or lower clip half 325. Also shown in FIG. 6D is fin 370 that slides into a corresponding slot 380 of outer wedges 322 and/or 326 as shown in FIG. 6E for aligning and securing together the inner and outer wedges. Another view of outer wedge 322 or 326 is also provided in FIG. 6E.

Additional modifications or enhancerrrents of the present invention may also be apparent to those of ordinary skill in the art. Thus, the particular combination of components described and photographs herein are intended to represent only certain embodiments of the present invention, and are not intended to serve as limitations of alternative clips within the spirit and scope of the invention.

I claim:

1. A barbell weight plate securing clip, comprising:

a first curved section and a second curved section, each of the first curved section and second curved section comprising an inner curved wedge section and a corresponding outer curved wedge section;

a plurality of shafts joining the first curved section and the second curved section;

a cam lever with a housing within the first curved section; and an interface between the inner curved wedge section and the corresponding outer curved wedge section of each of the first curved section and the second curved section, wherein the first curved section and the second curved section are sized to correspond to a diameter of a barbell to which the first curved section and the second curved section are to be secured.

2. The barbell weight plate securing clip of claim 1, wherein each of the outer curved wedge sections is configured to slide downwardly along the inner curved wedge section upon rotation of the cam lever in a direction that causes a distance between each of the outer curved wedge sections and the barbell to decrease.

3. The barbell weight plate securing clip of claim 1, further comprising a fin associated with the inner curved wedge section of each of the first curved section and the second curved section and a slot associated with the outer curved wedge section of each of the first curved section and the second curved section for receiving the fin and aligning the inner curved wedge section and the outer curved wedge section.

4. The barbell weight plate securing clip of claim 1, wherein cam lever is configured to increase a distance between each of the outer curved wedge sections and the barbell when the cam lever is rotated to an open position.

5. The barbell weight plate securing clip of claim 1, wherein the first curved section and the second curved section are configured to form an opening having a diameter greater than the diameter of a barbell to which the first curved section and the second curved section are to be secured.

6. The barbell weight plate securing clip of claim 1, wherein each of the inner curved wedge sections is configured to contact a barbell sleeve when the cam lever is rotated to a closed position.

7. The barbell weight plate securing clip of claim 1, wherein the outer curved wedge section and inner curved wedge section of each of the first curved section and the second curved section are increasingly slidably engaged by a lateral force exerted on the outer curved wedge section of each of the first curved section and the second curved section by the weight plate.

8. The barbell weight plate securing clip of claim 1, wherein the inner curved wedge section of each of the first curved section and the second curved section and the outer curved wedge section of each of the first curved section and the second curved section are constructed of rubber.

9. The barbell weight plate securing clip of claim 1, wherein the inner curved wedge section of each of the first curved section and the second curved section and the outer curved wedge section of each of the first curved section and the second curved section are constructed of plastic.

10. A method of securing a weight plate to a barbell, comprising the steps of:

inserting a first barbell end into a first rotatable barbell sleeve and a second barbell end into a second rotatable barbell sleeve;

sliding a first weight plate having a hole at a center point onto the first rotatable barbell sleeve and a second weight plate having a hole at a center point onto the second rotatable barbell sleeve;

sliding onto the first rotatable barbell sleeve a first clip having an upper curved section and a lower curved section connected by a plurality of shafts so as to secure the first weight plate between a collar on an interior end of the first rotatable barbell sleeve and the first clip; and rotating a cam lever associated with the upper curved section so as to slidably engage in a direction parallel to a longitudinal axis of the first rotatable barbell sleeve an inner curved wedge section of the first clip and an outer curved wedge section of the first clip.

11. The method of claim 10, wherein the outer curved wedge section of the first clip slides downwardly along the inner curved wedge section of the first clip upon rotation of the cam lever in a direction that causes a distance between the outer curved wedge section of the first clip and the barbell to decrease.

12. The method of claim 10, wherein a fin is disposed on the inner curved wedge section of the first clip and a slot for receiving the fin is disposed on the outer curved wedge section of the first clip for aligning the inner curved wedge section of the first clip and the outer curved wedge section of the first clip.

13. The method of claim 10, wherein the step of rotating further comprises rotating the cam lever to an open position, increasing a distance between the outer curved wedge section of the first clip and the barbell.

14. The method of claim 10, wherein the step of rotating further comprises rotating the cam lever to a closed position, decreasing a distance between the outer curved wedge section of the first clip and the barbell.

15. The method of claim 10, wherein the barbell has a diameter that is less than a diameter of an opening formed by the upper curved section, the lower curved section and a plurality of adjoining shafts.

16. The method of claim 10, wherein the rotating step further comprises the inner curved wedge section of the first clip contacting the first rotatable barbell sleeve.

17. The method of claim 10, wherein the rotating step further comprises increasingly slidably engaging the outer curved wedge section of the first clip and inner curved wedge section of the first clip by a lateral force exerted on the outer curved wedge section of the first clip by the first weight plate.

18. The method of claim 10, further comprising sliding onto the second rotatable sleeve a second clip having an upper curved section and a lower curved section connected by a plurality of shafts to secure the second weight plate between a collar on an interior end of the second rotatable barbell sleeve and the second clip.

19. The method of claim 10, wherein the inner curved wedge section of the first clip and the outer curved wedge section of the first clip are constructed of rubber.

20. The method of claim 10, wherein the inner curved wedge section of the first clip and the outer curved wedge section of the first clip are constructed of plastic.

* * * * *